US009027848B1

(12) United States Patent
Hilton et al.

(10) Patent No.: US 9,027,848 B1
(45) Date of Patent: May 12, 2015

(54) APPARATUS FOR WATERFALL EFFECT

(75) Inventors: Brooks Hilton, Oxnard, CA (US); Jason Hillyard, Oxnard, CA (US)

(73) Assignee: Waterway Plastics, Oxnard, CA (US)

( * ) Notice: Subject to any disclaimer, the term of this patent is extended or adjusted under 35 U.S.C. 154(b) by 468 days.

(21) Appl. No.: 13/417,608

(22) Filed: Mar. 12, 2012

(51) Int. Cl.

| | |
|---|---|
| ***B05B 17/08*** | (2006.01) |
| ***F21S 8/00*** | (2006.01) |
| ***B05B 1/36*** | (2006.01) |
| ***F23D 14/68*** | (2006.01) |
| ***B05B 1/14*** | (2006.01) |
| ***B05B 1/04*** | (2006.01) |
| ***E04H 4/14*** | (2006.01) |

(52) U.S. Cl.
CPC ..... *B05B 1/044* (2013.01); *B05B 17/085* (2013.01); *B05B 17/08* (2013.01); *B05B 1/36* (2013.01); *E04H 4/14* (2013.01); *E04H 4/148* (2013.01)

(58) Field of Classification Search
CPC ..... B05B 17/085; B05B 1/36; B05B 1/044
USPC ..... 239/597, 592, 17, 193–194; 4/507, 510, 4/512, 541.3, 541.1, 496
See application file for complete search history.

(56) References Cited

U.S. PATENT DOCUMENTS

| | | | | |
|---|---|---|---|---|
| 4,881,280 | A * | 11/1989 | Lesikar | 4/507 |
| 5,115,974 | A * | 5/1992 | Tobias et al. | 239/23 |
| 6,382,520 | B1 * | 5/2002 | Hones | 239/12 |

* cited by examiner

*Primary Examiner* — Len Tran
*Assistant Examiner* — Alexander Valvis
(74) *Attorney, Agent, or Firm* — Sandy Lipkin

(57) ABSTRACT

An apparatus that includes two separate reservoirs wherein the first reservoir is molded into the body of the larger artificial body of water and filled using a standard pump from the main body of water. From the larger body of water, the water is then moved upward through the apparatus through the manual opening of a valve assembly. Once the valve assembly is opened, the water moves through the valve assembly and through a grate and into a second reservoir. From this second reservoir, the water is pulled by the force gravity over the spillway into the main body of water, creating a clean, sheer waterfall effect.

8 Claims, 8 Drawing Sheets

APPARATUS FOR WATERFALL EFFECT

BACKGROUND OF THE INVENTION

1. Field of the Invention

The present invention relates generally to the field of aesthetic water effects, and specifically toward an improved apparatus for the inclusion in molded artificial bodies of water, such as pools, jetted baths and spas to create a soothing, clear waterfall effect or other water return effect.

2. Description of the Prior Art

In artificial bodies of water designed for use by humans, such as swimming pools, spas and whirlpools, it is often desirable for aesthetic and soothing purposes to include some sort of waterfall and/or water return feature in the body of water. Typically such waterfall and water return embellishments are external, self-contained attachments that are added to existing bodies of water. Furthermore, it has been shown to be quite difficult to create a clear appearance to the fall and/or water return feature.

It is the object of the instant invention to provide an improved apparatus to be molded into the substrate of the containing structure of an artificial body of water, i.e., that bath vessel or other water container that creates a clear, soothing waterfall effect or other water return feature. The design is economical in that there are fewer parts for potential repair and potential leakage.

SUMMARY OF THE INVENTION

The preferred embodiment of the present invention teaches an apparatus to create a water return effect comprising: a pre-fabricated container for the placement therein of water wherein said pre-fabricated body of water comprises: a bottom; one or more sidewalls; an open top; a perimeter top surface extending around said one or more sidewalls; a first reservoir for the collection of water that is created through attachment of a cover plate to a pre-molded open space in said pre-fabricated container, said cover plate further comprising: one or more apertures of variable shape and size to control the flow and shape of returning water out of said first reservoir wherein said first reservoir further comprises: an inlet conduit that allows water from said pre-fabricated container to be pumped through said inlet conduit into said first reservoir.

The above embodiment can be further modified by defining that a seat for the placement therein of a valve assembly that is connected between said inlet conduit and said first reservoir and controlled by a knob connected to said valve through an aperture in said cover plate, said cover plate further comprising at least one outlet for the return therethrough of water to said pre-fabricated body of water.

The above embodiment can be further modified by defining that a handle is attached to said valve assembly thereby allowing for manual opening and closing of said valve assembly.

The above embodiment can be further modified by defining that said cover plate further comprises: a first side that is the same length as said first reservoir and that seats into said pre-fabricated container of water; a second side and a third side which extend away from said first side in a substantially perpendicular direction thereto wherein said second side and said third side extend downward at angle away from said first side; a first sidewall and a second sidewall extending downward from said second side and said third side in a substantially perpendicular direction therefrom thereby creating a bottom, said bottom being molded with a rise in the center thereby creating a second reservoir of water on one side of said rise wherein on the opposite side of said rise a spillway is created over which water can fall; a vertical wall with a plurality of apertures extending downward from said first side to said bottom in a direction substantially perpendicular therefrom; and an aperture in said vertical wall through which said valve assembly fits.

The above embodiment can be further modified by defining that said apertures in said vertical wall are vertical, creating a grate.

The above embodiment can be further modified by defining that said outlet for the return of water to said main reservoir constitutes one or more single streams of water.

The above embodiment can be further modified by defining that said spillway is textured.

The above embodiment can be further modified by defining that said spillway is smooth.

The above embodiment can be further modified by defining that said cover plate consists of one or more pieces.

BRIEF DESCRIPTION OF THE DRAWINGS

This invention can better be understood by reference to the drawings, provided for exemplary purposes, and in which.

DETAILED DESCRIPTION OF A PREFERRED EMBODIMENT

Figure 1A:
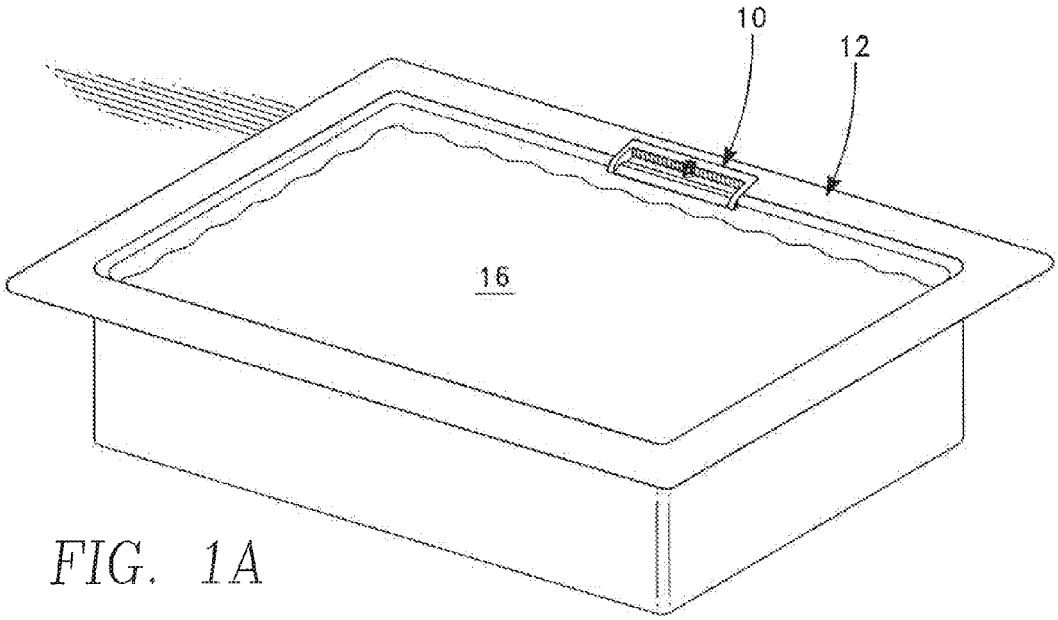
FIGS. 1A-C are perspective views of the invention as it would be included in A) a square shaped body of water, such as a pool; B) a round shaped body of water, such as a spa; and C) a generalized feature for any artificially created body of water.

The following is a list of the reference numbers for easy reference when referring to the drawings:

10 device
12 square-shaped pool
14 round-shaped spa
16 non-specified artificial body of water
20 interior vertical wall of artificial body of water
22 second reservoir in waterfall apparatus
24 spillway
26 grate
28 top of waterfall apparatus

30 first side of waterfall apparatus
32 second side of waterfall apparatus
34 manual handle on valve assembly
36 aperture in waterfall apparatus that connects manual to valve assembly
38 curvature in waterfall apparatus for handle
40 housing for valve assembly
42 plunger in valve assembly
44 bolt to secure valve assembly to body of water
46 nut to secure to bolt to secure valve assembly to body of water
48 first reservoir of water
50 check ball drain
51 retainer ring
52 first seal
54 second seal
56 indicator of water flow upward into valve assembly
58 indicator of water flow into sides of valve assembly
60 indicator of water flow from sides of valve assembly out to second reservoir
62 valve assembly
64 first sidewall of waterfall apparatus
66 second sidewall of waterfall apparatus
68 valve thread drive
70 manifold
72 valve opening apertures
74 valve seal seat
76 inlet conduit The instant invention is an attachable cover plate to be added to artificial bodies of water, such as pools and spas and the like that have been prefabricated to include a space for a first reservoir, a space for the cover plate and, optionally, a valve assembly pre-assembled and attached to the artificial body of water that allows water to move from the main body of water into the first reservoir. The valve assembly could either be pre-installed in the body of water or a space left for the installation thereto.

In the preferred embodiment, the apparatus includes two separate reservoirs. The first reservoir is filled using a standard pump from the main body of water. Water can be moved upward from the main body of water into the apparatus through the manual opening of a valve assembly. The valve controls the movement of water from the main body of water into the first reservoir. Once the valve assembly is opened, the water moves through the valve assembly into the first reservoir and then upward through the assembly and then through a grate and into a second reservoir. From this second reservoir, the water is pulled by the force of gravity over the spillway into the main body of water, creating a clean, sheer waterfall effect.

Figure 1B:
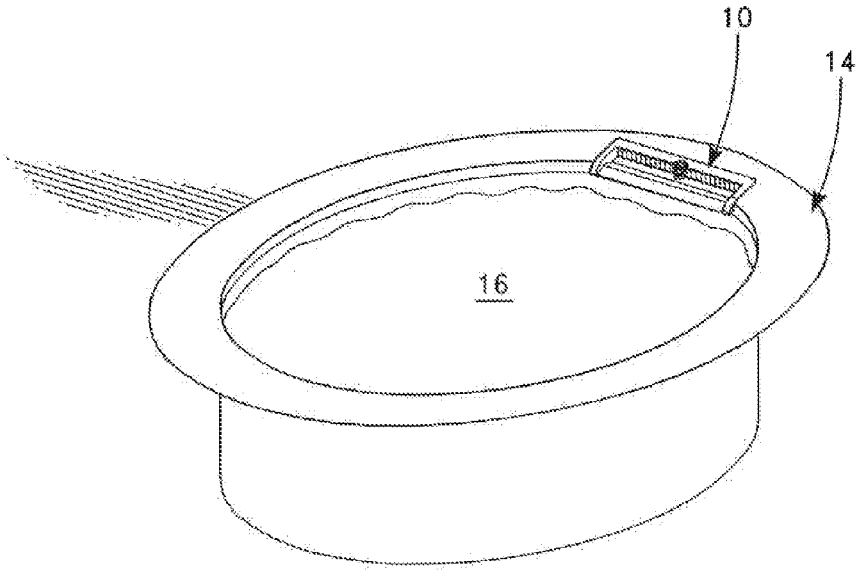
Figure 1C:
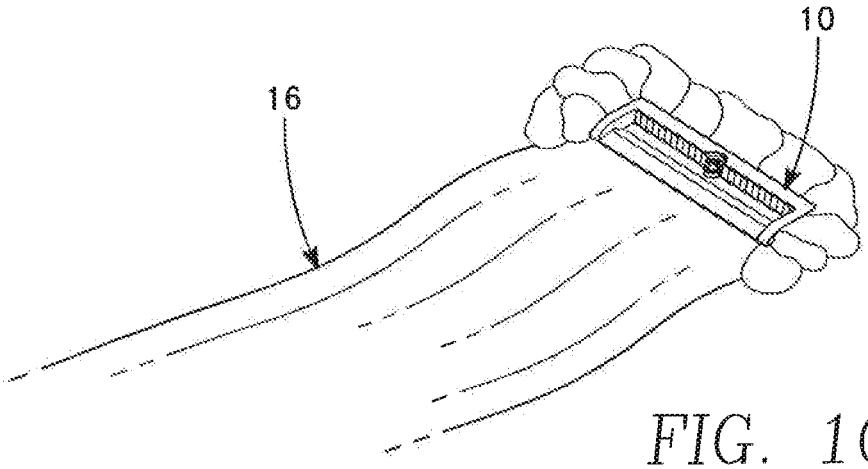

Seen in FIGS. 1A-1C, the apparatus is a waterfall creation assembly that fits into the structure of an artificially created body of water that has been pre-fabricated to make room for the apparatus 10 to be placed directly on the substrate. In FIG. 1A, the device is shown in a square-shaped 12 body of water 16, such as is typically found in swimming pools. In FIG. 1A, it is shown adapted for a round-shaped 14 body of water 16, such as a spa. In FIG. 1C it is seen in a non-specific body of water 16 that can be any shape at all. It is to be understood that the apparatus 10 is not limited to use in a specific style or shape of artificial body of water, but can be used whenever any construction is undertaken of an artificial body of water that would like to include the soothing and aesthetic appeal of a clean, quiet, smooth waterfall effect or other water return effect.

Figure 2:
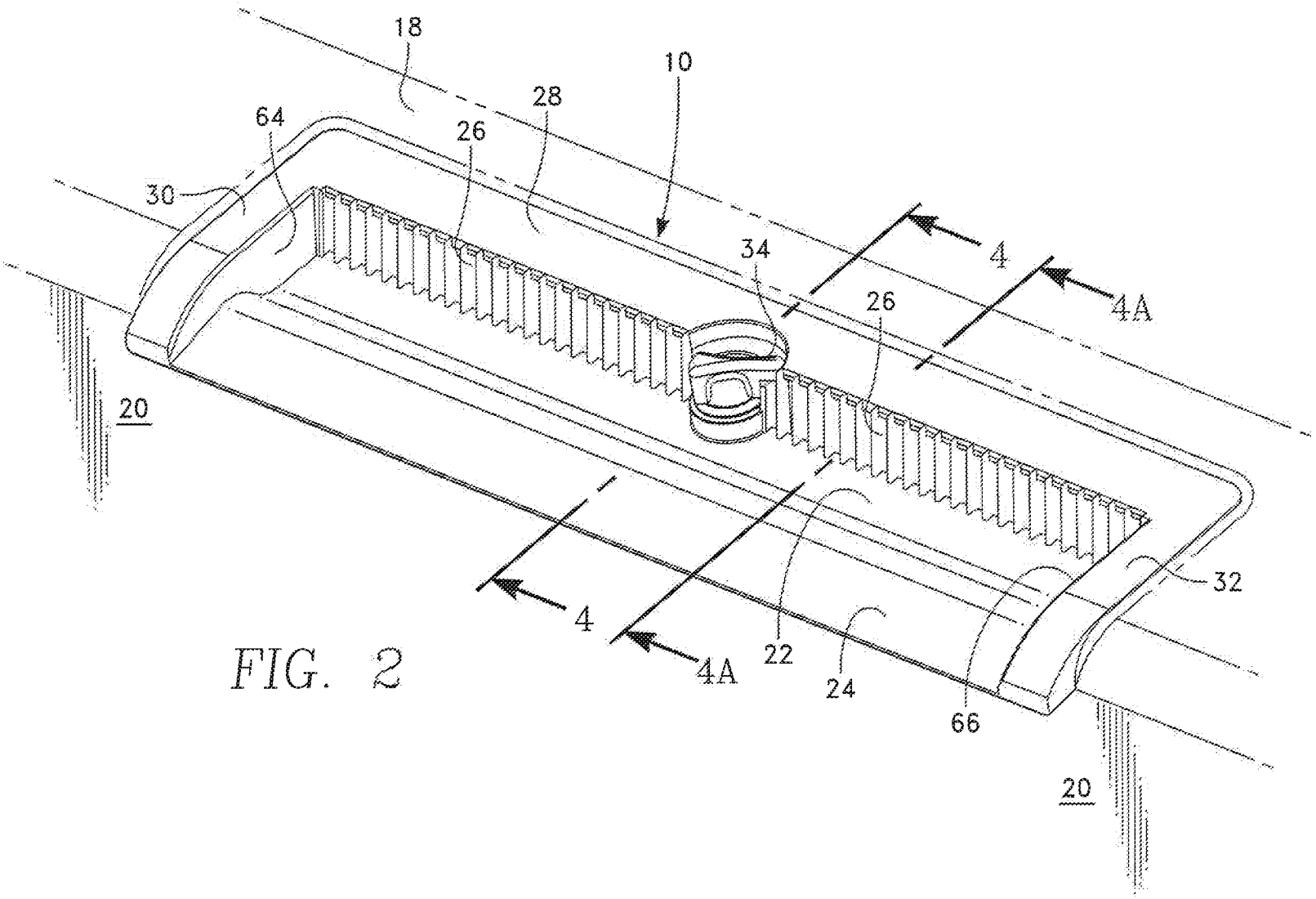
FIG. 2 is a close-up perspective view of the apparatus of the invention as it is seated in the molded portion of an artificial body of water, such as a pool or spa.

Referring now to FIG. 2 it is shown the perspective view of the waterfall apparatus 10 as it appears set against the top perimeter 18 of the body of water 16 and the interior vertical wall 20 of the body of water 16. The apparatus 10 has a top portion 28 and two side portions 30, 32. Between the side portions 30, 32 and the top portion 28 there is space created due to the fact that the side portions have walls 64, 66 that extend downward from the top wall 28 creating a second reservoir 22 therebetween. From the second reservoir 22, extending outward therefrom is the spillway 24 that extends the distance between the sidewalls 64, 66.

Figure 6:
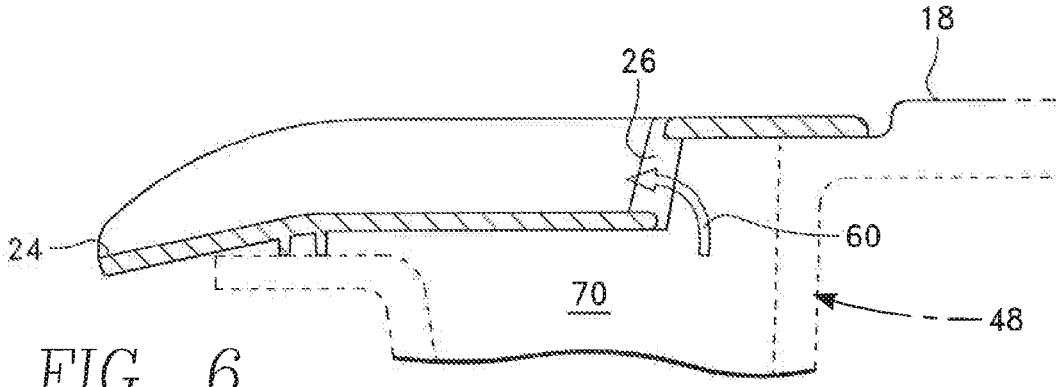
FIG. 6 is an alternate embodiment that does not contain the second reservoir after the water exits the first reservoir in the case where one or more streams of water are the desired water return effect.
Figure 7:
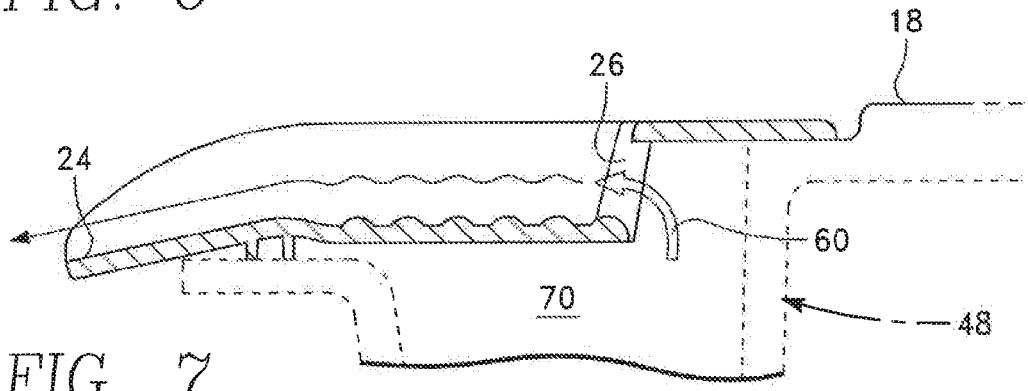
FIG. 7 shows an alternate embodiment wherein the spillway is texture for an optional turbulent waterfall effect.
Figure 8:
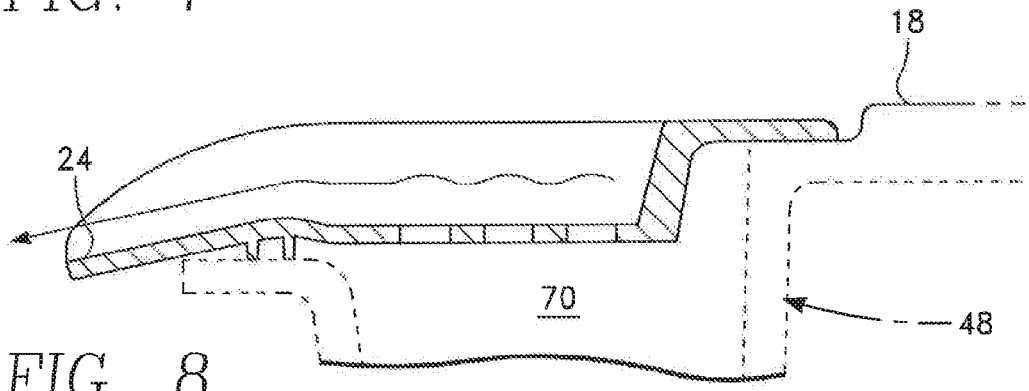
FIG. 8 is an alternate embodiment wherein no grated return structure is present thereby allowing the water to return without obstruction.
Figure 9:
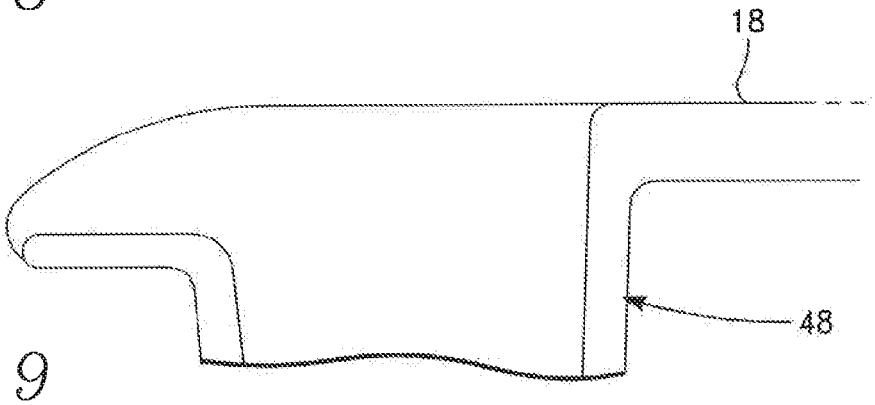
FIG. 9 is an alternate embodiment wherein there is no upper portion at all to the return cover thereby allowing for one or more streams of water for water return and including the second reservoir for a combination of effects.

Extending downward from the top portion 28 and toward the second reservoir 22 is a vertical wall that is broken up to create a grate 26 and allow for the flow of water therethrough. The grate can have any variety of designs to produce the desired effect of the waterfall once the water exits the first reservoir 70 and enters the second reservoir 22. Some alternate return effects are illustrated in FIGS. 6-9. In FIG. 6 it is demonstrated that the water can return to the main body of water without the first passage through a second reservoir. In FIG. 7, the spillway is textured allowing for a more turbulent effect. In FIG. 8 there is no grate for the return and in FIG. 9 there is no upper portion at all. For example, the water can return as a single stream of water or as one or more single streams of water. The water can return as a single or one or more single streams along with the fall over a spillway. And of course this return over the spillway can be smooth or it can be turbulent. The preferred embodiment defined herein explains one embodiment but it is to be understood that the effect of the water return is variable within the scope of this invention, which primarily defines a water return apparatus that is prefabricated into the substrate of the body of water.

Figure 3:
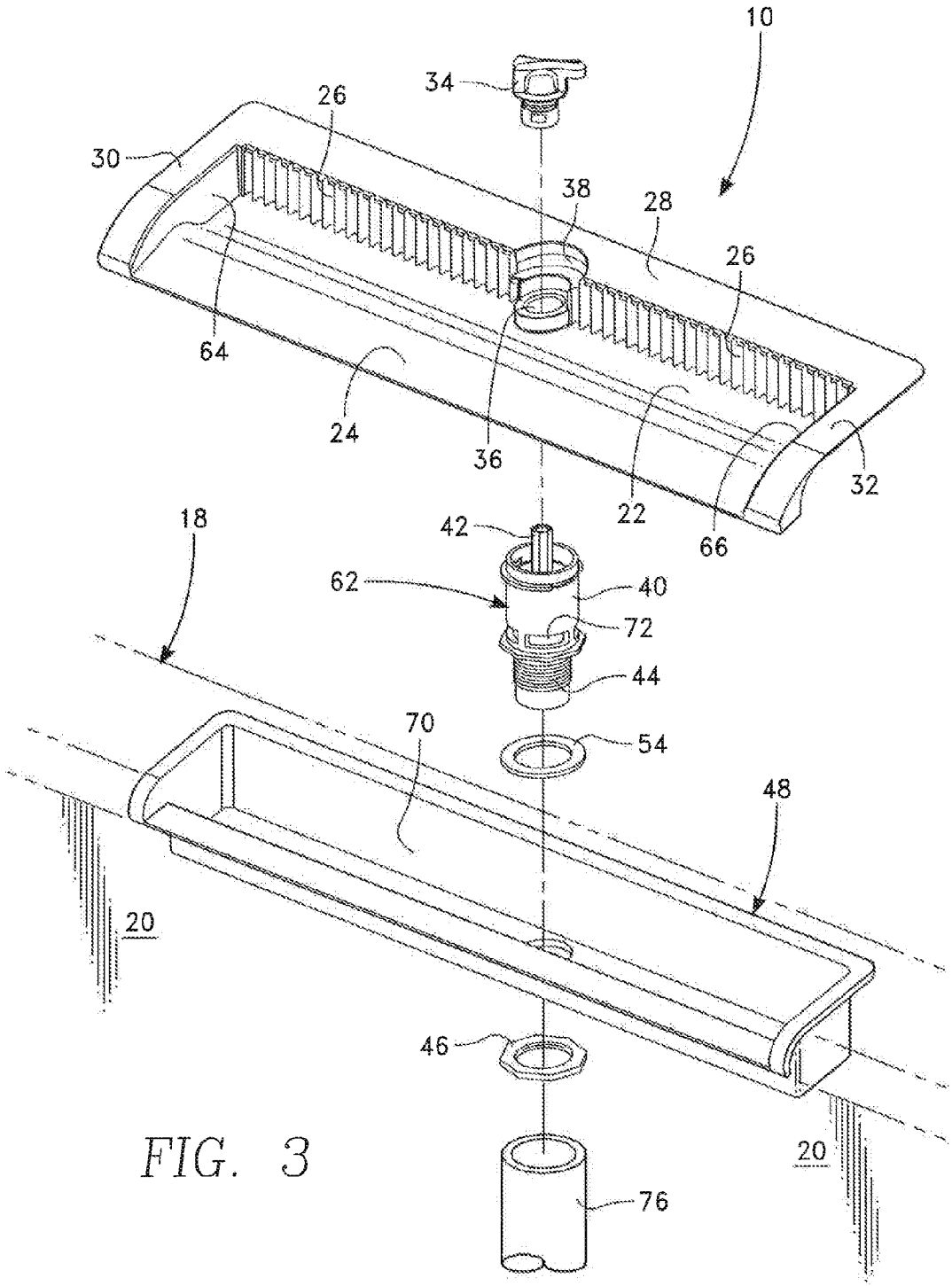
FIG. 3 is an exploded perspective view of the apparatus of the invention as it is seated in the molded portion of an artificial body of water, such as a pool or spa.

In the preferred embodiment defined herein, in substantially the center of the vertical grate wall 26 is an aperture 36 and a curvature in the vertical grate wall 38 that allows for the placement therein of a manually operated handle 34 that attaches to a valve assembly 62 that extends through the first reservoir 70 and attaches by means of a bulkhead feature of the valve body, containing a flange and male threads to a nut 46 that seats against the first reservoir substrate as the nut is threadably connected to the bulkhead feature of the valve body. The valve assembly 62 is installed into the pre-fabricated body of water. This is seen clearly in the exploded view shown in FIG. 3. The first reservoir 70, like the valve assembly 62 is also pre-fabricated into the artificial body of water. By having the substrate portion of the first reservoir 48 and valve assembly 62 prefabricated into the body of water, the installation of the waterfall apparatus is simple and it is easy to maintain as it introduces fewer parts for repair and fewer points for leakage.

Figure 5:
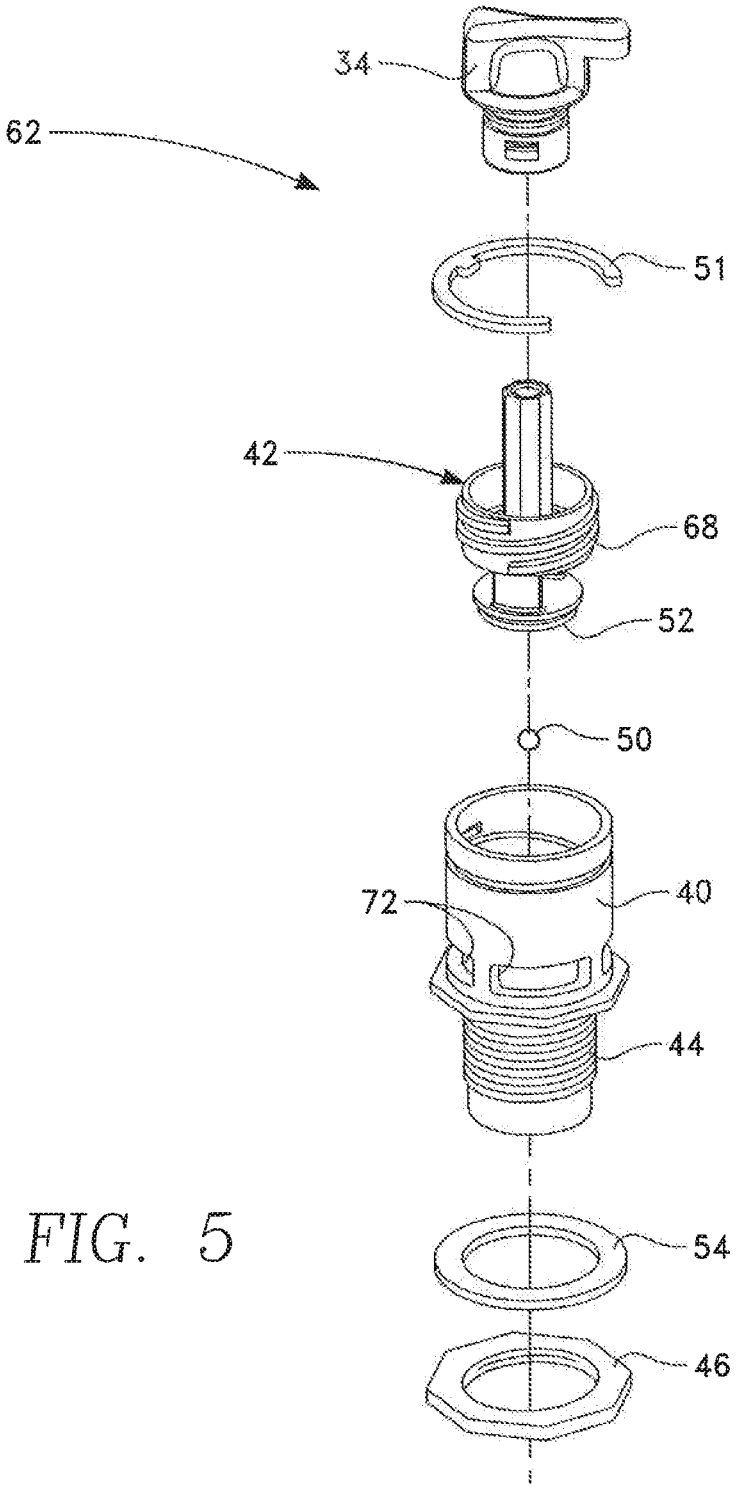
FIG. 5 is an exploded view of the valve assembly of the instant invention.

The valve assembly 62 is seen in detail in FIG. 5. The manually operated knob 34 attaches to a plunger 42 that is then placed inside of a housing 40 with a check ball drain 50 and retainer ring 51 that keeps the plunger 42 inside the housing 40 between them. The plunger 42 includes a threaded drive 68 and a sealing portion 52 that seals the plunger 42 inside the housing 40. The check ball drain 50 is included to help prevent stagnant water from remaining in the first and second reservoirs by allowing the apparatus to drain when the valve assembly 62 is closed and the pump is turned off. When the valve is open, the reservoirs drain without the assistance of the check ball drain. The housing 40 is mounted to the wall of the spa, pool or other artificial body of water and as stated above, is pre-fabricated for the easy attachment of the apparatus 10. The housing 40 includes a threaded bolt 44 that attaches to a nut 46 to help secure it to the body of water. Another seal 54 is included between the bolt 44 and nut 46. Included in the housing 40 are a series of apertures 72 to allow for water to move therethrough when the valve assembly 62 is open. The series of apertures 72 also acts as a baffle.

Figure 4:
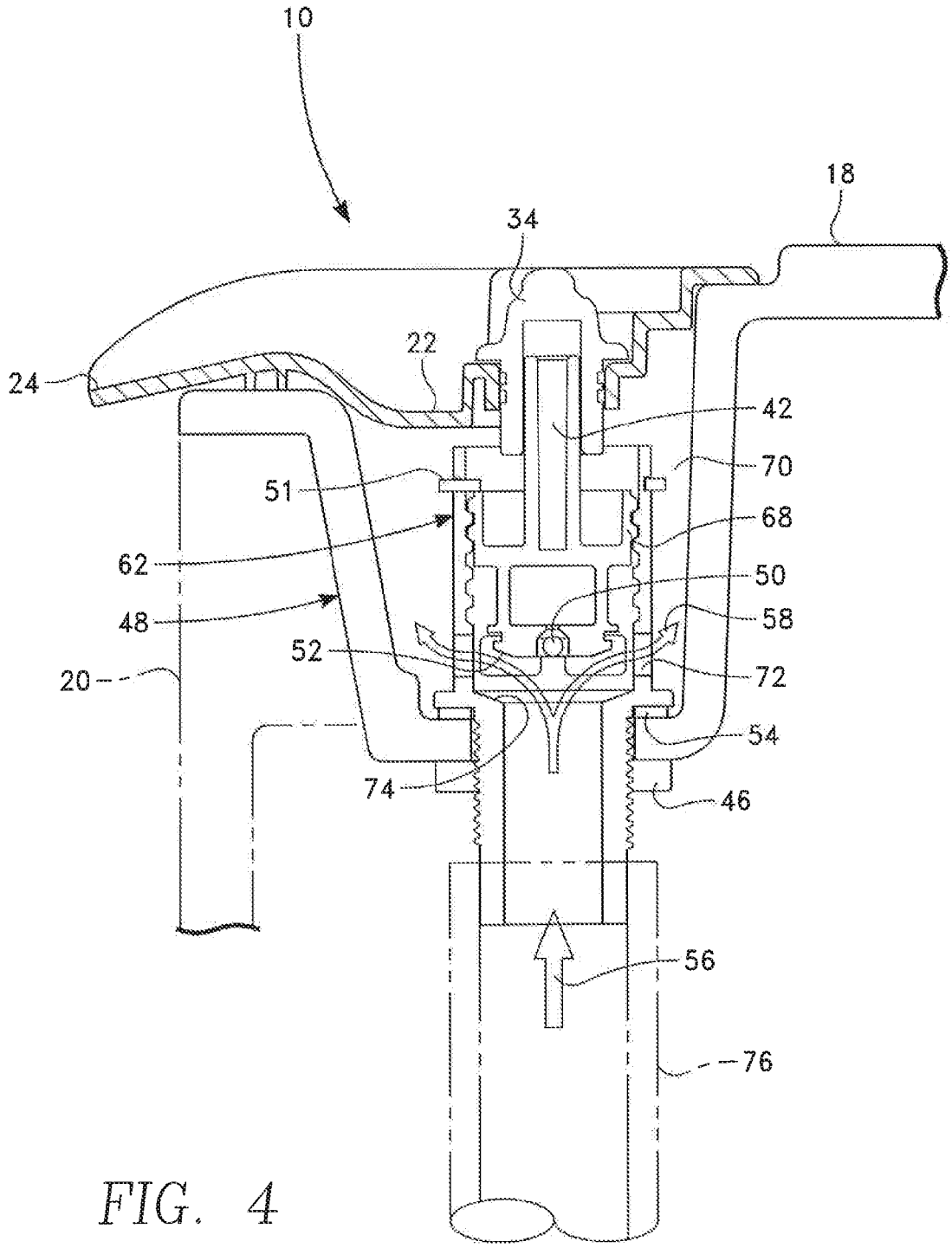
FIG. 4 is a taken along the line 4-4 in FIG. 2 wherein the valve is in the open position.
Figure 4A:
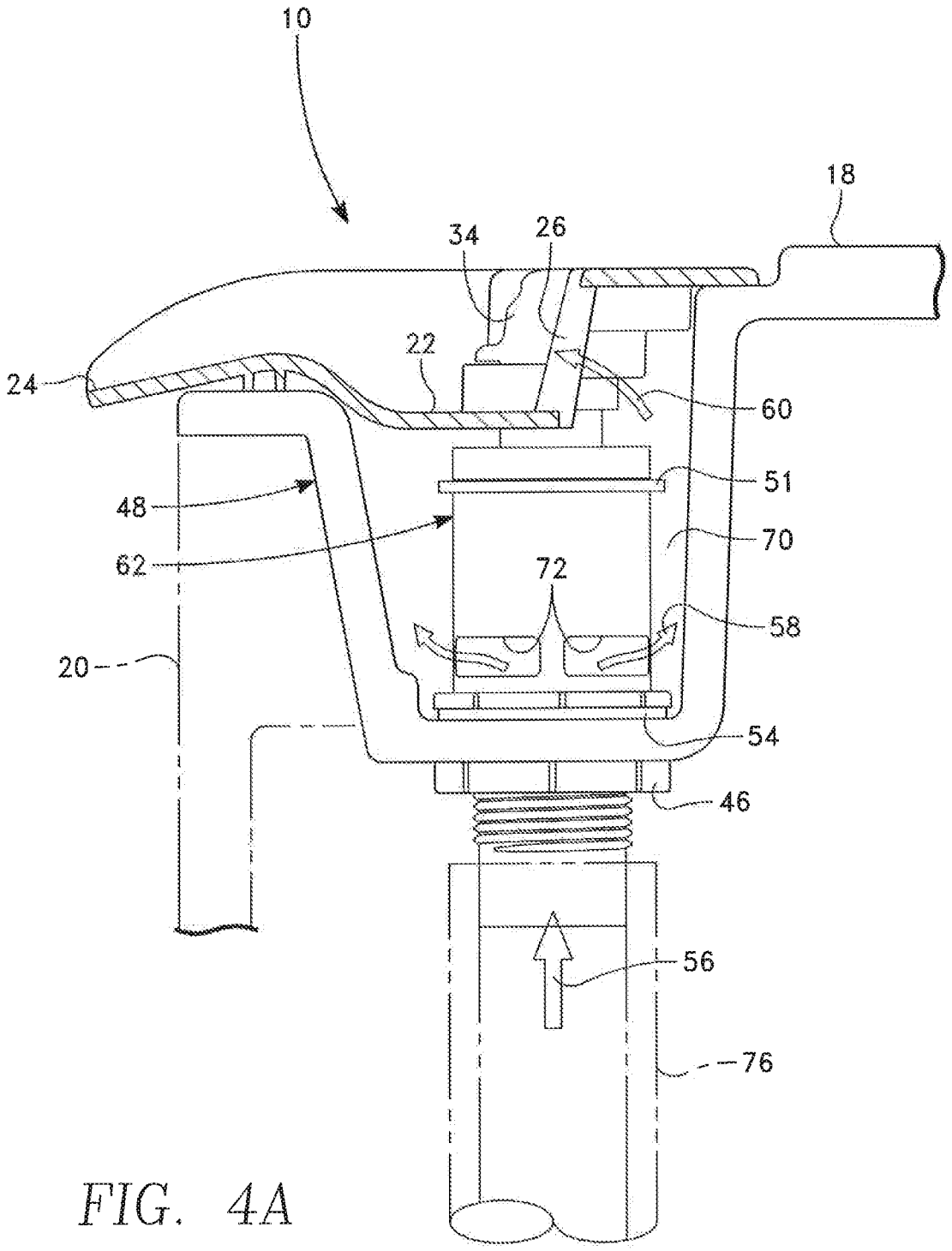
FIG. 4A is the same view as FIG. 4, but without view of the inner workings of the valve assembly.

FIGS. 4 and 4A show side views of the valve assembly 62 in operation. FIG. 4 shows the valve assembly 62 when it is open. When open, water enters through the bottom of the valve assembly under pressure from a pump. The water flow is controlled through the handle 34 and pump. When the valve assembly 62 is manually opened by the handle 34 and the pump is on, water 56 enters the valve assembly 62 and the waterfall apparatus 10.

As the water enters vertically through the valve assembly 62, it fills the space 58 inside the housing 40 and plunger 42. The water continues to move upward 60 and through the grate 26, into the second reservoir 22 and over the spillway 24 into the larger main body of water 16, thereby creating a pleasant waterfall effect. When the valve assembly 62 is closed and the pump turned off, no water moves therethrough.

It is important to note that the preferred embodiment defined herein is not the only embodiment. The crux of the invention provides that a reservoir of water is created partially through the substrate of the pre-fabricated body water and partially through the cover plate that provides the waterfall effect. The control of the effect is achieved by the shape and size of the opening or openings in the control plate as well as the shape of the control plate itself. The second reservoir may or may not exist depending on the water effect desired. Furthermore, the cover plate can be mounted horizontally through the top perimeter of the pre-fabricated water or could be mounted vertically on the sidewalls like a sconce.

The primary reservoir of water is not complete without either the cover or the substrate of the body of water itself.

The illustrations and examples provided herein are for explanatory purposes only and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An apparatus to create a water return effect comprising:
a spa or swimming pool in a pre-fabricated container for the placement therein of a main body of water wherein said pre-fabricated container comprises:
a bottom;
one or more sidewalls;
an open top;
a perimeter top surface extending around said one or more sidewalls;
a pre-molded open space in one or more sidewalls of said pre-fabricated container;
a first reservoir for the collection of water that is created through attachment of a cover plate to said pre-molded open space in said pre-fabricated container wherein said reservoir is defined by the space between said pre-molded open space and said cover plate wherein said cover plate further comprises:
at least one aperture to allow for the return of water from said first reservoir into said main body of water wherein said first reservoir further comprises:
an inlet conduit that allows water from said main body of water to be pumped through said inlet conduit into said first reservoir;
a seat for the placement therein of a valve assembly that is connected between said inlet conduit and said first reservoir and controlled by a knob connected to said valve through an aperture in said cover plate, said cover plate further comprising at least one outlet for the return therethrough of water to said main body of water wherein said cover plate further comprises:
a first side that is the substantially same length as said pre-molded open space and that seats into said pre-fabricated container of water;
a second side and a third side which extend away from said first side in a substantially perpendicular direction therefrom wherein said second side and said third side extend downward at angle away from said first side;
a first sidewall and a second sidewall extending downward from said second side and said third side in a substantially perpendicular direction therefrom thereby creating a bottom, said bottom being molded with a rise in the center thereby creating a second reservoir of water on one side of said rise wherein on the opposite side of said rise a spillway is created over which water can fall;
a vertical wall with a plurality of apertures extending downward from said first side to said bottom in a direction substantially perpendicular therefrom; and
an aperture in said vertical wall through which said valve assembly fits.

2. The apparatus as defined in claim 1 wherein a handle is attached to said valve assembly thereby allowing for manual opening and closing of said valve assembly.

3. The apparatus as defined in claim 1 wherein said apertures in said vertical wall are vertical, creating a grate.

4. The apparatus as defined in claim 1 wherein said outlet for the return of water to said main reservoir constitutes one or more single streams of water.

5. The apparatus as defined in claim 1 wherein said spillway is textured.

6. The apparatus as defined in claim 1 wherein said spillway is smooth.

7. The apparatus as defined in claim 1 wherein said cover plate consists of two or more pieces.

8. The apparatus as defined in claim 1 wherein said at least one aperture includes two or more apertures wherein said two or more apertures are variable in size and shape.

* * * * *